United States Patent [19]

Ohashi

[11] Patent Number: 4,631,369

[45] Date of Patent: Dec. 23, 1986

[54] DISTRIBUTOR FOR AN INTERNAL COMBUSTION ENGINE

[75] Inventor: Yutaka Ohashi, Himeji, Japan

[73] Assignee: Mitsubishi Denki Kabushiki Kaisha, Tokyo, Japan

[21] Appl. No.: 774,731

[22] Filed: Sep. 11, 1985

[30] Foreign Application Priority Data

Sep. 21, 1984 [JP] Japan ..... 59-199033

[51] Int. Cl.[4] ..... H01H 1/00; H01H 19/00

[52] U.S. Cl. ..... 200/19 R; 200/19 DR

[58] Field of Search ..... 200/19 R, 19 DR, 262, 200/263-267; 338/66; 123/146.5 A, 633

[56] References Cited

U.S. PATENT DOCUMENTS

| | | | |
|---|---|---|---|
| 2,766,338 | 10/1956 | Jamieson et al. | 200/19 DR |
| 3,361,886 | 1/1968 | Prickett | 200/19 DR X |
| 4,166,201 | 8/1979 | Olander et al. | 200/19 DR |
| 4,425,485 | 1/1984 | Sone et al. | 200/19 DR X |
| 4,475,491 | 10/1984 | Grunwald | 200/19 DR X |

OTHER PUBLICATIONS

"Suppression of Radio Frequency Interference at the Distributor Rotor Gap" by Wey-Chaung Kuo, May 1979.

*Primary Examiner*—J. R. Scott

*Attorney, Agent, or Firm*—Leydig, Voit & Mayer

[57] ABSTRACT

A distributor for suppressing radio frequency interference (RFI) in the ignition system of an internal combustion engine including a rotor electrode having adhered thereto on at least one of its surfaces a wire net combined with a dielectric material and a contact electrode making contact with the rotor electrode for supplying a high voltage from an ignition coil to the rotor electrode. Various types of dielectric materials and wire nets are used. Also, a plurality of wire net, including the dielectric material, can be utilized to prevent the exfoliation of the dielectric material from the rotor electrode.

9 Claims, 8 Drawing Figures

DISTRIBUTOR FOR AN INTERNAL COMBUSTION ENGINE

BACKGROUND OF THE INVENTION

This invention relates to a distributor for an internal combustion engine, and in particular to a distributor for suppressing radio frequency interference or radio noise (hereinafter referred to as RFI) which is generated between a rotor electrode and a lateral terminal electrode forming the distributor in the ignition system of an internal combustion engine. This invention also relates to a method of making the rotor electrode used in such a distributor.

A conventional distributor for an internal combustion engine is shown in FIG. 1. A distributor rotor electrode 10 molded in a distributor rotor 11 is positioned to face a lateral terminal electrode 12 through a discharging gap "g". FIG. 1 only shows a single lateral terminal electrode 12, but actually the distributor has a plurality of lateral terminal electrodes corresponding to the number of cylinders of an engine (not shown). A contact electrode 14 makes contact with the rotor electrode 10 and supplies a high voltage from an ignition coil (not shown) to the rotor electrode 10 through a secondary high-tension cable 16. The contact electrode 14 is pressed, with a spring 18, against the rotor electrode 10 rotated by a rotary axle 20 interconnected to the crankshaft of an internal combustion engine. A dielectric material 22 mainly formed of silicon is coated entirely on the discharging end, i.e. the periphery end of the rotor electrode 10.

In operation, when a high voltage is supplied to the rotor electrode 10 through the high-tension cable 16 and the contact electrode 14, the dielectric material 22 serves to increase the emission of electrons from the rotor electrode 10 towards the lateral terminal electrode 12 to start a discharge at a voltage lower than a usual breakdown voltage in the discharge gap "g". This reduction of the breakdown voltage in the discharge gap suppresses the generation of the RFI.

However, in the presence of the silicon dielectric material 22 fully coated on the discharging end of the rotor electrode 10, intermittent discharges arise due to charged particles accumulated in the dielectric material 22 during the induced discharge, whereby a sufficient effect for suppressing the RFI is not attained. Furthermore, being exposed to the discharge, the silicon dielectric material 22 is easily exfoliated and dropped from the end of the rotor electrode 10 so that it can not retain the RFI suppressing effect for long periods of time, resulting in a poor durability and operability. Also, since the dielectric material 22 is coated on the top end of the rotor electrode 10 one at a time, the dielectric material 22 is not practical from the view of the mass-production thereof.

On the other hand, a published article tilted "Suppression of Radio Frequency Interference at the Distributor Rotor Gap" (IEEE Trans. Vehicular Technology Vol. 1, VT-28, No. 2, May 1979) by Wey-Chang Kuo discloses that when a dielectric material is disposed at the rotor segment, the RFI and breakdown voltage is greatly reduced. The dielectric material may comprise compounds of silicon oxide, zinc oxide, glass, and various ceramics.

SUMMARY OF THE INVENTION

It is accordingly an object of the present invention to provide a distributor for suppressing the RFI of an internal combustion engine having a high durability and a low manufacturing cost suitable for mass-production by reducing the intermittent discharges by decreasing the amount of the dielectric material disposed at the top end of the rotor electrode.

For this object in view, this invention improves a distributor for an internal combustion engine having a rotor electrode rotating together with the rotary axle of the engine, a plurality of lateral terminal electrodes disposed through a discharge gap in the rotating locus of the rotor electrode, and a contact electrode which makes contact with the rotor electrode for supplying a high voltage to the rotor electrode. A wire net having a dielectric matrial between the meshes is provided on the surface of the rotor electrode making contact with the contact electrode. As an alternative, this wire net with its dielectric material can be mounted on the back surface of the rotor electrode to provide a smooth contact for the contact electrode.

Another object of the present invention is to provide a novel method of making a rotor electrode of a distributor for an internal combustion engine. To accomplish this objective a liquid dielectric material is first coated on at least one of both surfaces of an electrode member provided in the form of a plate. Then, a wire net is disposed over said dielectric material on said coated electrode member. In the next step, the resultant whole unit is heated to solidify the dielectric material. Finally, the whole unit is pressed to make the rotor electrode.

The dielectric material is held into the meshes of the wire net section by section. The wire net also forms a part of a discharge electrode through the discharge gap and is held by the dielectric material over the entire wire net, so that the area contacting between the discharge electrode and the dielectric material is increased to reduce the breakdown voltage of the dielectric material.

BRIEF DESCRIPTION OF THE DRAWINGS

Throughout the figures, the same reference numerals indicate identical or corresponding parts.

DETAILED DESCRIPTION OF THE PREFERRED EMBODIMENT

Figure 2:
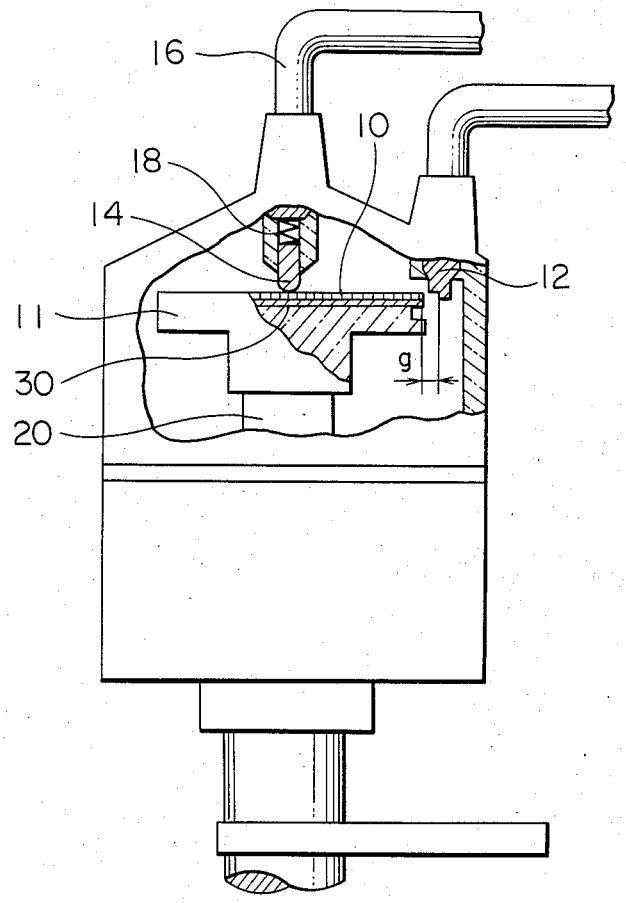
FIG. 2 shows a partly broken side view of a distributor for an internal combustion engine according to one embodiment of the present invention; and, FIGS. 3A, 3B and 3C show a plan view, a side view, and a front view respectively of the arrangement of a distributor rotor electrode and a wire net which are adhered to each other by a varnish mainly composed of a silicon varnish.
Figure 3A:
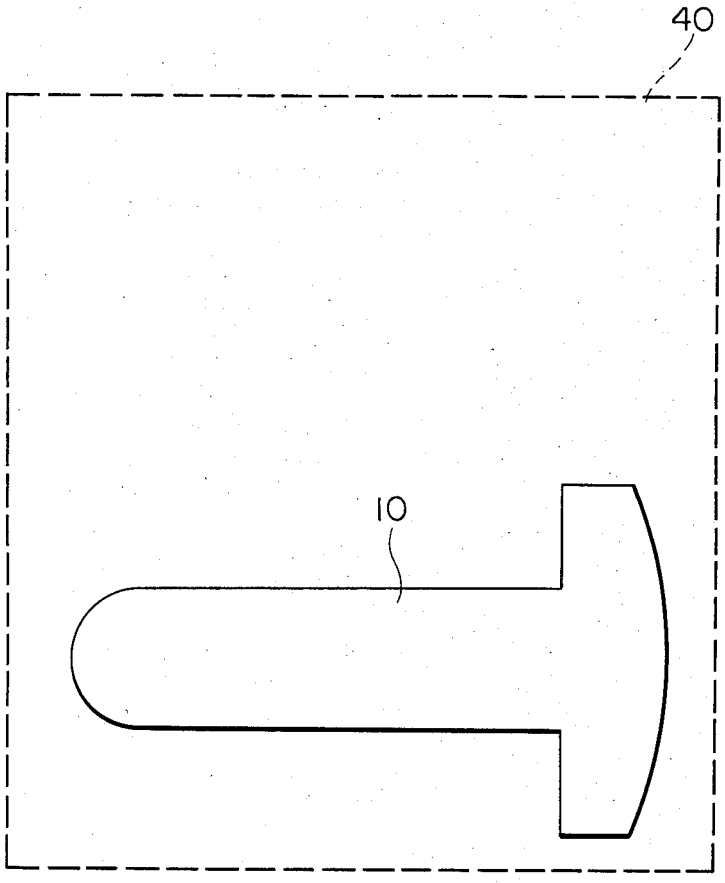
Figure 3B:
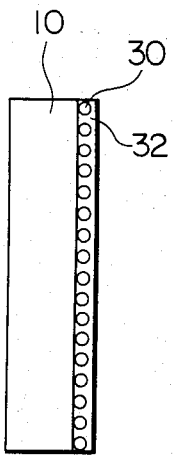
Figure 3C:
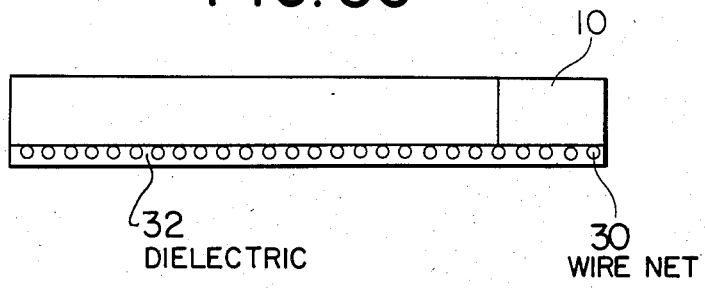
Figure 4A:
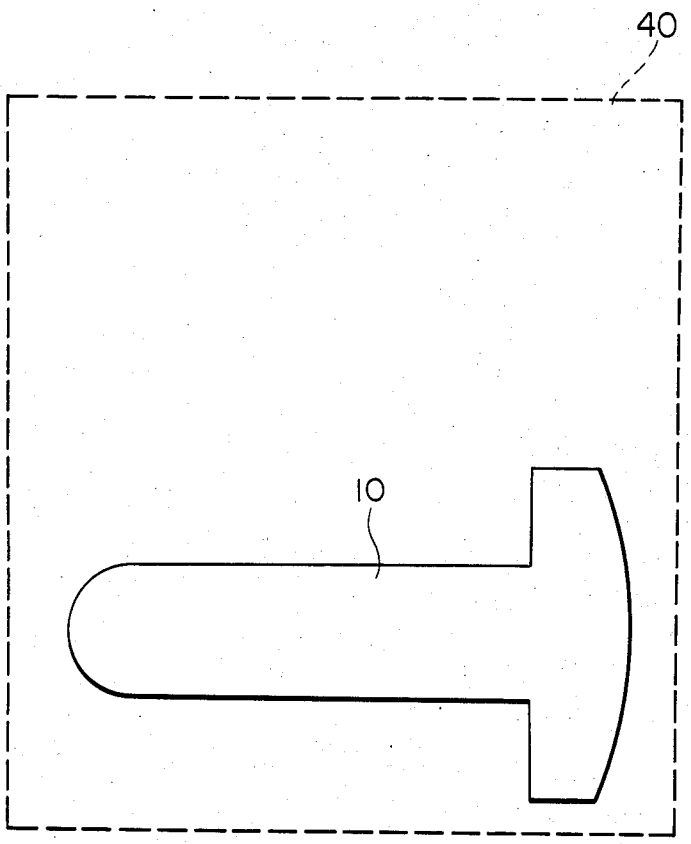
FIGS. 4A, 4B and 4C show a plan view, a side view, and a front view, respectively, of the arrangement of a distributor rotor electrode having a plurality of wire net and dielectric material layers.
Figure 4B:
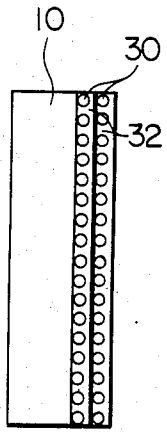
Figure 4C:
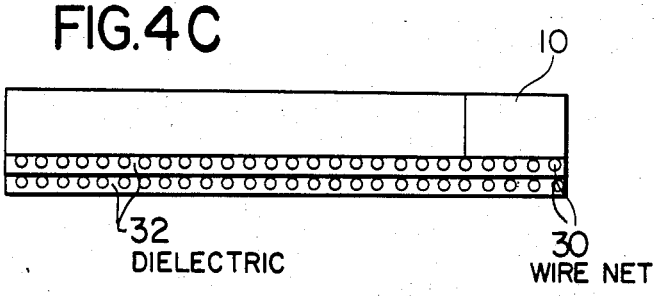

A preferred embodiment of a distributor for an internal combustion engine according to the present invention will now be described with reference to FIGS. 2 and 3. In FIG. 2 showing the structure of the distributor of this invention, a wire net 30 made of brass and having 40 to 200 mm meshes is adhered to the bottom surface of the rotor electrode 10. A layer of dielectric material 32 (FIG. 3) mainly composed of silicon is provided on the top surface of the rotor electrode contacting the contact electrode 14. The adhesion of the wire net 30 as well as of the dielectric material 32 to the rotor electrode 10 as shown in FIG. 3 is carried out as follows. First of all, the dielectric material 32 which is in liquid state at this stage is thinly coated with the thickness of 50–700 microns on an electrode member 40 provided in the form of a plate (shown by dotted lines). The wire net 30 is then placed over the liquid dielectric material 32 on the electrode member 40. The resultant whole unit is then heated to solidify the liquid dielectric material 32, whereby the wire net 30 and the dielectric material 32 which is now solid are fixedly adhered to the electrode member 40. Subsequently, the electrode member 40 is pressed to take the shape of the rotor electrode 10 as shown in FIG. 3. As a result, there is no need to adhere the wire net 30 and the dielectric material 32 to the rotor electrode 10 section by section and one by one in order to make a number of the rotor electrodes 10, thereby allowing this rotor electrode to be easily mass-produced. Finally, the rotor electrode shown in FIG. 3 is molded to make the distributor rotor 11.

Figure 1:
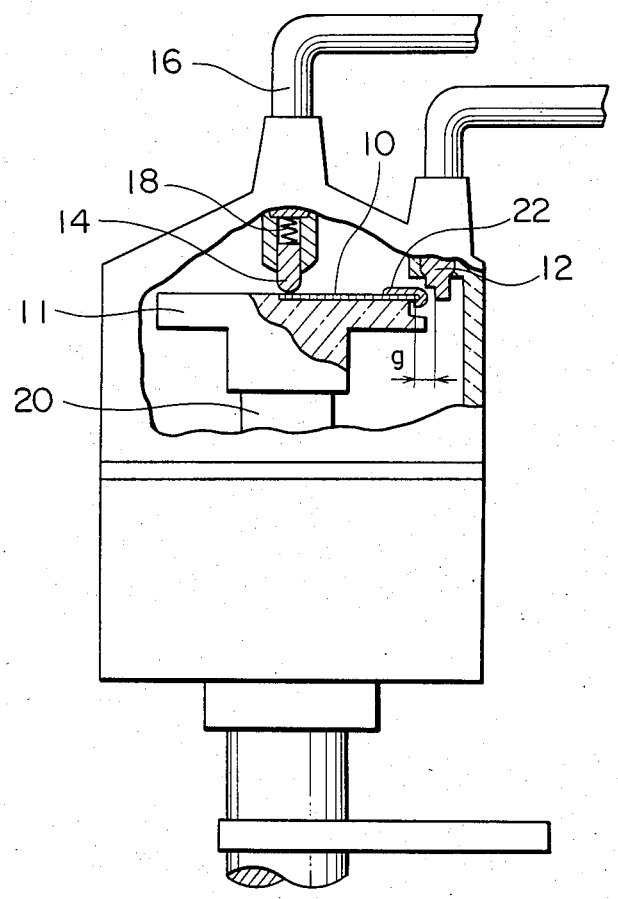
FIG. 1 (PRIOR ART)
FIG. 1 shows a partly broken side view of a prior art distributor for an internal combustion engine.

As can be seen, since the wire net 30 is adhered to or makes contact with the entire surface of the rotor electrode 10 coated with the dielectric material 32, the wire net 30 forms a part of the discharging electrode, including the rotor electrode 10, to increase the contacting area between the dielectric material 32 and the discharging electrode. Also, the silicon component composing the dielectric material 32 greatly contributes to reduce the breakdown voltage across the discharge gap "g". Therefore, even a little amount of dielectric material can provide an effect of sufficiently reducing the breakdown voltage. At the same time the reduction of the absolute amount of the dielectric material at the top periphery of the rotor electrode 10 shown in FIG. 1 decreases the conventionally charged particles to be accumulated which give rise to the above noted intermittent discharges, thereby effectively suppressing the RFI resulting from the intermittent discharges. Furthermore, since the dielectric material 32 is divided or sectioned into respective meshes of the wire net 30, it is merely exfoliated at each mesh, thereby preventing the exfoliation or peeling of the dielectric material 32 from the rotor electrode 10 itself. Therefore, the effect of suppressing the RFI is retained for long periods of time. In the above embodiment, since the dielectric material 32 mainly composed of silicon and the wire net 30 made of brass, which characteristically bonds well with the dielectric material 32, are employed, the dielectric material 32 is stiffly supported with the wire net 30 so that the dielectric material 32 is difficult to exfoliate.

It is to be noted that while the above embodiment shows a case where the wire net 30 is adhered to the bottom surface of the rotor electrode 10 to permit the silicon contact electrode 14 to contact the rotor electrode 10 by means of the dielectric material 32, it may also be effectively adhered to the opposite top surface of the rotor electrode 10 contacting the contact electrode 14 or to both surface. Also, instead of a single layer the wire net 30 may be effectively formed of a plurality of layers on the surface of the plate including the dielectric material. Moreover, while the above embodiment employs the dielectric material 32 mainly composed of silicon, the dielectric material 32 may be mainly composed of silicon carbide (SiC), or aluminum oxide ($Al_2O_3$) instead of silicon. Also, the wire net 30 may be made of bronze instead of brass.

According to this invention thus described, there is provided a distributor for suppressing the RFI of an internal combustion engine in which a dielectric material is adhered either on the top surface of the rotor electrode which contacts the contact electrode or the bottom surface thereof or both. Consequently, the absolute amount of the dielectric material at the discharging end of the rotor electrode can be reduced while the contacting area between the dielectric material and the discharging electrode is increased, so that this distributor for an internal combustion engine generates little intermittent discharges and therefore provides an excellent durability and a sufficient RFI suppressing effect while it is cheap and suitable for mass-production.

It is to be noted that while the present invention has been described with reference to the above embodiments illustrated in the accompanying drawings, it should not be limited to them and may be applied with various modifications thereof without departing from the spirit of the invention

What I claim is:

1. In a distributor for suppressing radio frequency interference in the ignition system of an internal combustion engine having a rotor rotated by said engine, the improvement comprising:

a rotor electrode carried by said rotor, said electrode including a plate having a bottom surface facing said rotor and a top surface, and a dielectric material adhered to one of said surfaces of said plate;

a plurality of lateral terminal electrodes disposed in the rotating locus of said rotor and separated from said rotor electrode by a discharge gap;

a contact electrode contacting said rotor electrode for supplying a high voltage to said rotor electrode; and a wire net disposed on said dielectric material, said dielectric material being present in the openings of said wire net and bonding said wire net to said one surface of said plate.

2. The improvement in a distributor for an internal combustion engine as claimed in claim 1 wherein said wire net and said dielectric material are disposed on the entire extent of said one surface.

3. The improvement in a distributor for an internal combustion engine as claimed in claim 1, wherein said dielectric material is mainly composed of silicon.

4. The improvement in a distributor for an internal combustion engine as claimed in claim 1, wherein said dielectric material is mainly composed of silicon carbide.

5. The improvement in a distributor for an internal combustion engine as claimed in claim 1, wherein said dielectric material is mainly composed of aluminum oxide.

6. The improvement in a distributor for an internal combustion engine as claimed in claim 1, wherein said wire net is made of brass.

7. The improvement in a distributor for an internal combustion engine as claimed in claim 1, wherein said wire net is made of bronze.

8. The improvement in a distributor for an internal combustion engine as claimed in claim 1 including a plurality of said wire nets in layers on said one surface of said plate, each layer including dielectric material.

9. The improvement in a distributor for an internal combustion engine as claimed in claim 1, said dielectric material and said wire net being adhered to the bottom surface of said plate and said rotor.

* * * * *